United States Patent [19]

Greis et al.

[11] 4,193,446

[45] Mar. 18, 1980

[54] INTERMEDIATE STEAM SUPERHEATER

[75] Inventors: Ingemar Greis, Sturefors; Lars-Olof Ingesson, Linghem, both of Sweden

[73] Assignee: Stal-Laval Apparat AB, Linkoping, Sweden

[21] Appl. No.: 825,775

[22] Filed: Aug. 18, 1977

[30] Foreign Application Priority Data

Aug. 20, 1976 [SE] Sweden ..... 7609256

[51] Int. Cl.[2] ..... F28B 9/02

[52] U.S. Cl. ..... 165/108; 122/483; 165/114

[58] Field of Search ..... 165/108, 113, 111, 114; 122/483, 32

[56] References Cited

U.S. PATENT DOCUMENTS

| | | | |
|---|---|---|---|
| 1,798,795 | 3/1931 | Hilger | 165/108 |
| 2,097,602 | 11/1937 | Rohlin | 165/108 |
| 2,217,410 | 10/1940 | Howard | 165/108 |
| 3,203,475 | 8/1965 | Crews et al. | 165/108 |

FOREIGN PATENT DOCUMENTS

| | | | |
|---|---|---|---|
| 664479 | 9/1929 | France | 165/108 |
| 1135510 | 4/1957 | France | 165/108 |
| 1263254 | 2/1972 | United Kingdom | 165/108 |

*Primary Examiner*—Sheldon J. Richter
*Attorney, Agent, or Firm*—Kenyon & Kenyon

[57] ABSTRACT

An intermediate steam superheater includes a heat exchanger comprising a bundle of tubes supplied with steam and subject to the disadvantage that the steam may condense completely in some of the tubes while passing freely through others of the tubes with a consequent loss of heating efficiency. This is corrected by sucking the steam from the outlet ends of the tubes and injecting it into the inlet ends of the tubes so that such a high flow rate occurs through the tubes that the tubes are kept substantially free from condensate while the steam is continuously recirculated through all of the tubes, the condensate from the condensed portion of the steam being discharged from the heat exchanger.

1 Claim, 2 Drawing Figures

INTERMEDIATE STEAM SUPERHEATER

BACKGROUND OF THE INVENTION

A typical nuclear power plant includes high pressure and low pressure turbines which drive generators producing the plant's electrical output, the steam for the high pressure turbine being provided via the output of the steam generating reactor installation. The steam goes first to the high pressure turbine and via an intermediate superheater to the low pressure turbine.

Some of the steam generated by the nuclear installation supplies the intermediate superheater to raise the temperature of the steam leaving the high pressure turbine and going to the low pressure turbine.

Such an intermediate superheater sometimes comprises a vertical casing having a bottom provided with an inlet for the steam leaving the high pressure turbine, and a top providing an outlet for the steam going to the low pressure turbine. One or more heat exchangers are positioned inside of this casing, each comprising a bundle of upstanding tubes which may be vertical or inclined, the tubes having an inlet manifold for their upper ends and an outlet manifold for their lower ends. The inlet manifold has an inlet for the steam from the nuclear installation and the outlet manifold has an outlet for condensate.

When operating as intended to superheat the steam passing through the casing for use by the low pressure turbine, the steam entering the inlet manifold of the heat exchanger should flow downwardly in a uniform manner through all of the tubes of the bundle of tubes, with the steam giving up all of its heat to the steam going to the low pressure turbine, the steam ultimately completely condensing at or near the tube bottoms and being withdrawn from the outlet manifold as a water condensate.

Unfortunately, generally the operation of such an intermediate superheater involves the problem that the steam completely condenses in some of the tubes while passing freely through others of the tubes so as to exhaust into the outlet manifold and be lost via the condensate discharge. In addition, the tube or tubes where complete condensation has occurred becomes blocked by the pressure of the freely passed steam exhausting into the outlet manifold, the blocked water introducing the possiblilty of tube corrosion at an unexpected rate. If the steam supplied to the intermediate supereheater's heat exchanger includes a non-condensable gas, such as air, such a gas also has a tendency to collect in some of the tubes so as to decrease the heat efficiency desired. In other words, it is possible for both water and air to collect in those parts of the bundle of tubes where stationary or static conditions exist.

It is possible to avoid the above indicated problem, by increasing the steam flow from the reactor installation through the bundle of tubes of the intermediate superheater. With enough steam water and non-condensable gases can be flushed and kept flushed out of the bundle of tubes. This has the disadvantage that the surplus of steam is discharged through the condensate drain of the heat exchanger's oulet manifold, so that the heat content of this surplus steam is lost.

SUMMARY OF THE INVENTION

According to the present invention, with such an intermediate superheater an improvement is provided in the form of recirculating means for sucking steam from the heat exchanger's outlet manifold and injecting it into the inlet manifold at a flow rate recirculating the steam through the bundle of tubes at a flow rate keeping the tubes substantially free from steam condensate and recirculating the uncondensed steam through the tubes until condensed. In this way all of the tubes of the tube bundle of the superheater exchanger are continuously flushed free from condensate even though condensate may form more rapidly in one tube than in another. The condensate which collects in the outlet manifold is drained in the usual fashion but the steam is recirculated through the tubes at a high flow rate until condensed.

Uncondensable gas possibly included by the steam supplied by the steam generator to the intermediate superheater, cannot be removed via the condensate drain of the tube bundle outlet manifold, but to prevent an excess of such gas being recirculated along with the steam, a small amount of the recirculating flow can be continuously discharged. A minor amount of the recirculating steam is thus lost but along with it the uncondensable gas is also removed to prevent it from becoming concentrated in the recirculating flow.

BRIEF DESCRIPTION OF THE DRAWINGS

An example of the present invention is schematically illustrated by the accompanying drawings in which:

FIG. 2 shows the recirculating circuit with the heat exchanger shown by itself and without showing the casing of the superheater.

DETAILED DESCRIPTION OF THE INVENTION

Figure 1:
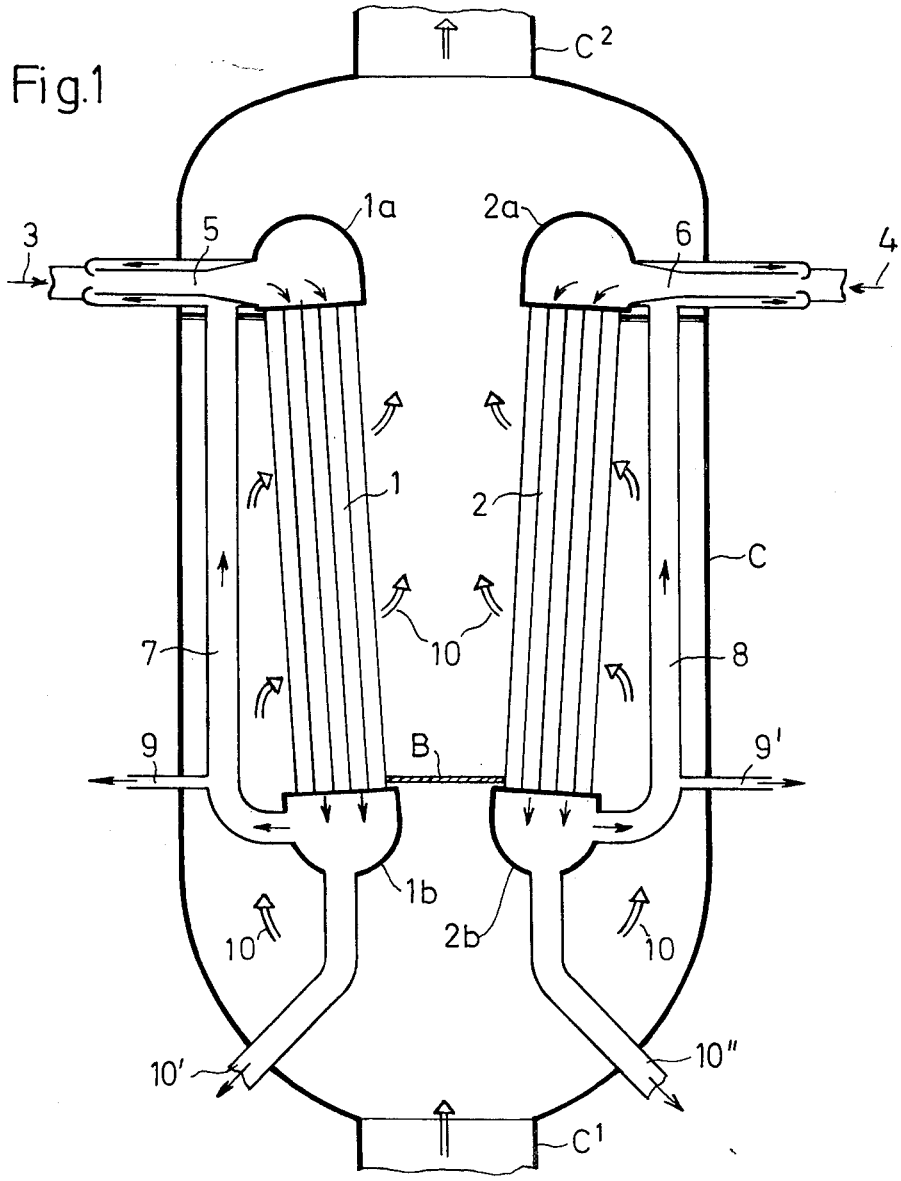
FIG. 1 in vertical section shows an intermediate superheater embodying the principles of this invention.

Having reference to the accompanying drawings, in FIG. 1 the intermediate superheater is shown as having two bundles of tubes 1 and 2 upstanding in an inclined manner and respectively having upper inlet manifolds 1*a* and 2*a* and lower outlet manifolds 1*b* and 2*b*. The steam generated by the reactor installation enters at 3 and 4 respectively to the inlet manifolds 1*a* and 2*a*, via jet pumps 5 and 6 respectively. This steam may have a temperature of 280° C. and a pressure of 65 bar. This steam goes downwardly through the tube bundles, hopefully uniformly with uniform condensation, the consensate being drained or exhausted from the outlet manifolds 1*b* and 2*b* via drains 10' and 10''. This condition of uniformity rarely exists, if at all; the jet pumps are part of this invention.

With the present invention the jet pump or injector 5 sucks steam and uncondensable gas from the outlet manifold 1*b* of the tube bundle 1 and via a recirculating pipe 7 mixes it with the steam entering at 3. In this way a recirculation with the high flow rate is obtained via the tubes of the bundle 1 keeping all of the tubes continually substantially free from condensate and possibly uncondensable gas. The jet pump or injector 6 does the same thing for the tube bundle 2, the recirculation being via the pipe 8 in this instance.

The high flow rate recirculation through the tube bundles not only assures that all of the tubes are kept free from stationary collections of condensate, but also it assures that all of the useful heat of the steam is obtained; substantially only condensate leaves the heat exchangers. Both heat exchangers obtain the same advantage.

To prevent the accumulation to an undesirable degree of non-condensable gas such as air, the pipes 7 and 8 are provided with discharge outlets 9 and 9' respectively. These discharge outlets are of small flow rate and serve to continuously bleed off or possibly discontinuously bleed off a small amount of steam carrying along with it the described gas. In addition to air, such gas may include other gases that are non-condensable.

As usual, the illustrated intermediate superheater has the exchangers enclosed by a vertical and usually cylindrical casing C though which the exhaust steam from the high pressure turbine passes via a bottom inlet C1 and an upper outlet C2, this steam, which is the secondary medium, being illustrated as to its flow by the hollow arrows 10. The heat exchangers which receive the steam generated by the reactor installation, can be considered as having the primary medium supply.

As shown by the hollow arrow 10, it can be seen that the heat exchangers function as cross-flow exchangers, the casing C having a baffle arrangement generally indicated at B which forces the secondary medium to flow to the periphery of the casing C and then inwardly to cross-flow with respect to the tube bundles 1 and 2, while going to the casing's outlet C2. The casing's inlet and outlet are coaxially positioned with respect to the casing and the tube bundles are symmetrically arranged inside of the casing. Although two bundles are shown, the number may range from one to more than two.

FIG. 2 is provided to emphasize the foregoing and with the understanding that the principles of this invention are applicable to any cross-flow heat exchanger in general.

In this case a bundle of tubes 11 is shown into which the primary steam enters at 12 with the cross-flow of secondary medium being indicated by the hollow arrows 13. The condensate is shown discharging at 14 while the recirculating flow is indicated at 15 with the small discharge primarily for the removal of non-condensable gas being shown at 16. The recirculating flow 15 is via a pipe 17, the jet pump or injector 18 forcing up the flow 15 as shown at 19 and driving it back to enter the upper ends of the tubes 11 at 12. The primary medium is indicated as entering the injector at 20. The lower ends of the tubes 11 have the outlet manifold 21 while their upper ends have the inlet manifold 22.

As emphasized by FIG. 2, without an excess or surplus supply of primary medium at 20, the recirculating concept provides a high flow rate through the tubes 11 keeping them flushed free from condensate and non-condensable gases which might otherwise become stationary and force the primary medium flow to occur only through the remaining tubes. Assuming the input at 20 is steam having a temperature of 280° C. as previously exemplifed, with the pressure of 65 bar, the recirculating medium 15, together with the primary medium 20, superheats the secondary medium indicated by the hollow arrows 13 to from 150° to 260° C., for example. The values given are typical in the case of steam leaving a high pressure turbine and going to a low pressure turbine. Substantially all of the heat of the primary medium is saved, the steam condensing completely for withdrawal via 14 but without substantial loss of the primary medium or steam.

Although the recirculation has been shown as receiving its power via jet pumps or injectors powered by the primary medium, other power means can be used. For example, although not illustrated, the primary medium or steam from the reactor installation, can be used to power a turbine driving a compressor which provides for the recirculation. Other power sources are conceivable.

However, it is believed that the best and most efficient way for obtaining the recirculating power is via the use of the jet pumps or injectors previously described. The use of such power sources makes the entire intermediate superheater self-contained and substantially free from maintenance. Substantially none of the heat of the primary steam is lost uselessly.

What is claimed is:

1. A fluid heater comprising a casing having an inlet and an outlet and through which via the casing a flow of fluid to be heated is passed, said casing containing at least one heat exchanger comprising a bundle of tubes forming unrestricted flow passageways and having an inlet manifold for one of their ends and an outlet manifold for the other of their ends, the inlet manifold having an inlet for steam and the outlet manifold having discharging means for discharging steam condensate therefrom, so that the steam passes through the bundle of tubes to heat the fluid passed through the casing with steam condensate forming in the tubes flowing through the tubes and outlet manifold to said discharging means, said heat exchanger normally being subject to substantially complete steam condensation in some of its said tubes and to free passage of uncondensed steam through others of its tubes; wherein the improvement comprises a recirculating means for sucking steam from said outlet manifold and without flow restriction forcing it into said inlet manifold at a flow rate recirculating the steam through said bundle of tubes at a flow rate flushing condensate from the tubes and recirculating the uncondensed steam through the tubes substantially until condensed, said heat exchanger being positioned with its inlet manifold higher than its outlet manifold, and said tubes extending downwardly from the inlet manifold to the outlet manifold, said outlet manifold forming means for separating steam from said condensate and connecting the separated steam to said recirculating means and said condensate to said discharging means, said recirculating means including a means for discharging an amount of steam from the recirculating steam and which is small in volume as compared to the volume of the recirculating steam, thereby reducing the concentration of any non-condensable gas in the recirculating steam and which gas may have been included by the steam supplied to the inlet of said inlet manifold of the heat exchanger.

* * * * *